US008845048B2

(12) United States Patent
Koyama

(10) Patent No.: US 8,845,048 B2
(45) Date of Patent: Sep. 30, 2014

(54) LIQUID EJECTING DEVICE, STORAGE MEDIUM, AND METHOD OF CONTROLLING LIQUID EJECTING DEVICE

(75) Inventor: Keita Koyama, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 142 days.

(21) Appl. No.: 13/433,844

(22) Filed: Mar. 29, 2012

(65) Prior Publication Data

US 2013/0050317 A1 Feb. 28, 2013

(30) Foreign Application Priority Data

Aug. 31, 2011 (JP) ..... 2011-189939

(51) Int. Cl.
*B41J 29/38* (2006.01)
*B41J 2/045* (2006.01)

(52) U.S. Cl.
CPC ..... *B41J 2/04563* (2013.01); *B41J 2/0459* (2013.01); *B41J 2/04581* (2013.01)
USPC ..... 347/5; 347/11; 347/17

(58) Field of Classification Search
CPC ..... B41J 2/0459
See application file for complete search history.

(56) References Cited

U.S. PATENT DOCUMENTS 6,193,344 B1 * 2/2001 Otsuka et al. ..... 347/11
8,736,105 B2 * 5/2014 Haaf et al. ..... 307/31
2009/0295854 A1 * 12/2009 Kawakami et al. ..... 347/10
2010/0103211 A1 * 4/2010 Miyazaki et al. ..... 347/10
2011/0018919 A1 * 1/2011 Oshima et al. ..... 347/9
2013/0195496 A1 * 8/2013 Yamazawa ..... 399/88
2014/0092154 A1 * 4/2014 Uchino ..... 347/10

FOREIGN PATENT DOCUMENTS

JP S62-061110 A 3/1987
JP 2000-203018 A 7/2000
JP 2003-180073 A 6/2003
JP 2006-034025 A 2/2006

* cited by examiner

*Primary Examiner* — Shelby Fidler
(74) *Attorney, Agent, or Firm* — Baker Botts L.L.P.

(57) ABSTRACT

A power supply section includes a switching regulator. A plurality of linear regulators is provided for respective ones of a plurality of driving sections. The linear regulators step down a source voltage to respective driving voltages of the driving sections and supply the respective driving sections with the driving voltages. A head-temperature sensor measures temperature of a liquid ejecting head. A controller determines the source voltage and the driving voltages based on the temperature, and controls the power supply section, the linear regulators, and the driving sections to stop at least one of outputting of the source voltage by the power supply section, supplying of the driving voltages by the linear regulators, and driving of the driving sections, when a voltage difference is larger than or equal to an acceptable value. The voltage difference is a difference between the source voltage and a minimum voltage of the driving voltages.

21 Claims, 8 Drawing Sheets

LIQUID EJECTING DEVICE, STORAGE MEDIUM, AND METHOD OF CONTROLLING LIQUID EJECTING DEVICE

CROSS REFERENCE TO RELATED APPLICATIONS

This application claims priority from Japanese Patent Application No. 2011-189939 filed Aug. 31, 2011. The entire content of the priority application is incorporated herein by reference.

TECHNICAL FIELD

The invention relates to a liquid ejecting device, a storage medium storing a set of program instructions executable on a liquid ejecting device, and a method of controlling a liquid ejecting device.

BACKGROUND

A print-head-voltage controlling device is conventionally known that steps down a source voltage outputted from a switching power supply unit with a print-head-voltage control circuit to obtain driving voltages of a plurality of print heads. With this technology, an inexpensive three-terminal regulator is used as the print-head-voltage control circuit. In order to obtain stable outputs, a voltage difference between an IN terminal and an OUT terminal of the three-terminal regulator is set to a fixed voltage (for example, 1.5V) or higher.

SUMMARY

In the above-described technology, the voltage difference between the IN terminal and the OUT terminal of the three-terminal regulator is set to a fixed voltage (for example, 1.5V) or higher. If this voltage becomes too high, there is a possibility that the circuit of the three-terminal regulator is deteriorated because the amount of heat generation in the three-terminal regulator becomes too large. That is, in the above-described technology, the print-head-voltage control circuit performs a second voltage control with a target of driving voltages stored in a driving-voltage table for respective temperature environments. However, if a targeted driving voltage becomes too low, a step-down amount (a regulating amount) becomes large, which increases the amount of heat generation in the three-terminal regulator and can deteriorate the circuit with heat.

In view of the foregoing, it is an object of the invention to provide a liquid ejecting device that suppresses deterioration of linear regulators due to heat, a storage medium storing a set of program instructions executable on the liquid ejecting device, and a method of controlling the liquid ejecting device.

In order to attain the above and other objects, the invention provides a liquid ejecting device. The liquid ejecting device includes a liquid ejecting head, a power supply section, a plurality of linear regulators, a head-temperature sensor, and a controller. The liquid ejecting head has a plurality of driving sections for ejecting liquid. The power supply section includes a switching regulator configured to output a source voltage. The plurality of linear regulators is provided for respective ones of the plurality of driving sections. The plurality of linear regulators is configured to step down the source voltage to respective driving voltages of the plurality of driving sections and to supply the respective ones of the plurality of driving sections with the driving voltages. The head-temperature sensor is configured to measure temperature of the liquid ejecting head. The controller is configured to: determine the source voltage and the driving voltages based on the temperature measured by the head-temperature sensor; and control the power supply section, the plurality of linear regulators, and the plurality of driving sections to stop at least one of outputting of the source voltage by the power supply section, supplying of the driving voltages by the plurality of linear regulators, and driving of the plurality of driving sections, when a voltage difference is larger than or equal to an acceptable value. The voltage difference is a difference between the source voltage and a minimum voltage of the driving voltages.

According to another aspect, the invention also provides a storage medium storing a set of program instructions executable on a liquid ejecting device. The liquid ejecting device includes: a liquid ejecting head having a plurality of driving sections for ejecting liquid; a power supply section including a switching regulator configured to output a source voltage; a plurality of linear regulators provided for respective ones of the plurality of driving sections, the plurality of linear regulators being configured to step down the source voltage to respective driving voltages of the plurality of driving sections and to supply the respective ones of the plurality of driving sections with the driving voltages; and a head-temperature sensor configured to measure temperature of the liquid ejecting head. The set of program instructions includes: measuring temperature of the liquid ejecting head with the head-temperature sensor; determining the source voltage and the driving voltages based on the temperature measured by the head-temperature sensor; and controlling the power supply section, the plurality of linear regulators, and the plurality of driving sections to stop at least one of outputting of the source voltage by the power supply section, supplying of the driving voltages by the plurality of linear regulators, and driving of the plurality of driving sections, when a voltage difference is larger than or equal to an acceptable value. The voltage difference is a difference between the source voltage and a minimum voltage of the driving voltages.

According to still another aspect, the invention also provides a method of controlling a liquid ejecting device. The liquid ejecting device includes: a liquid ejecting head having a plurality of driving sections for ejecting liquid; a power supply section including a switching regulator configured to output a source voltage; a plurality of linear regulators provided for respective ones of the plurality of driving sections, the plurality of linear regulators being configured to step down the source voltage to respective driving voltages of the plurality of driving sections and to supply the respective ones of the plurality of driving sections with the driving voltages; and a head-temperature sensor configured to measure temperature of the liquid ejecting head. The method includes: measuring temperature of the liquid ejecting head with the head-temperature sensor; determining the source voltage and the driving voltages based on the temperature measured by the head-temperature sensor; and controlling the power supply section, the plurality of linear regulators, and the plurality of driving sections to stop at least one of outputting of the source voltage by the power supply section, supplying of the driving voltages by the plurality of linear regulators, and driving of the plurality of driving sections, when a voltage difference is larger than or equal to an acceptable value. The voltage difference is a difference between the source voltage and a minimum voltage of the driving voltages.

According to still another aspect, the invention also provides a liquid ejecting device. The liquid ejecting device includes a plurality of liquid ejecting heads, a power supply section, a plurality of linear regulators, a plurality of head-temperature sensors, and a controller. Each of the plurality of liquid ejecting heads has at least one driving section for ejecting liquid, thereby having a plurality of driving sections in total. The power supply section includes a switching regulator configured to output a source voltage. The plurality of linear regulators is provided for respective ones of the plurality of driving sections. The plurality of linear regulators is configured to step down the source voltage to respective driving voltages of the plurality of driving sections and to supply the respective ones of the plurality of driving sections with the driving voltages. The plurality of head-temperature sensors is configured to measure temperatures of the plurality of liquid ejecting heads. The controller is configured to: determine the source voltage and the driving voltages based on the temperatures measured by the plurality of head-temperature sensors; and control the power supply section, the plurality of linear regulators, and the plurality of driving sections to stop at least one of outputting of the source voltage by the power supply section, supplying of the driving voltages by the plurality of linear regulators, and driving of the plurality of driving sections, when a voltage difference is larger than or equal to an acceptable value. The voltage difference is a difference between the source voltage and a minimum voltage of the driving voltages.

BRIEF DESCRIPTION OF THE DRAWINGS

Embodiments in accordance with the invention will be described in detail with reference to the following figures wherein.

DETAILED DESCRIPTION

An inkjet printer embodying a liquid ejecting device according to an embodiment of the invention will be described while referring to FIGS. 1 through 9. In the following embodiment, ink is used as an example of liquid, an ink ejecting head is used as an example of a liquid ejecting head, and a sheet of paper (hereinafter, simply referred to as "paper") is used as an example of a recording medium.

Figure 1:
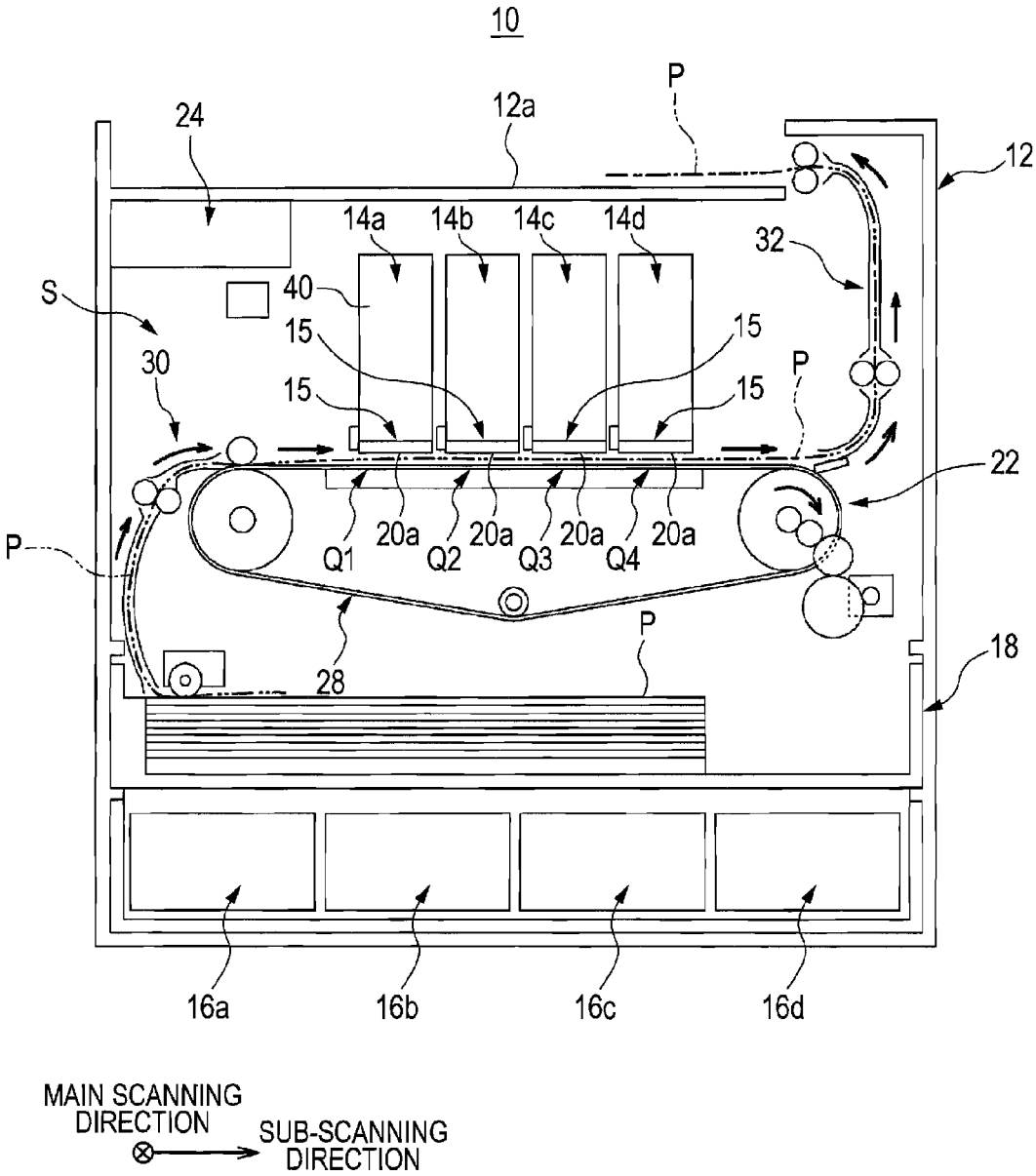
FIG. 1 is a schematic view showing the configuration of an inkjet printer according to an embodiment.

As shown in FIG. 1, an inkjet printer 10 includes a housing 12, four head units 14*a*-14*d* for respective ones of ink in four colors (magenta, cyan, yellow, and black), and four ink tanks 16*a*-16*d* that individually accommodate respective ones of ink in the four colors. The inkjet printer 10 further includes a paper cassette 18 that accommodates paper P, a paper conveying mechanism 22 that conveys the paper P, and a controller 24.

As shown in FIG. 1, the housing 12 has a space S therein for accommodating various units. A paper discharging section 12*a* is provided on an upper surface of the housing 12 for receiving paper P discharged to outside of the housing 12. The ink tanks 16*a*-16*d* are detachably arranged at a lower part of the space S. The paper cassette 18 is detachably disposed above the ink tanks 16*a*-16*d* in the lower part of the space S. The head units 14*a*-14*d* and the controller 24 are arranged at an upper part of the space S. The paper conveying mechanism 22 is disposed at a center and upper part of the space S in the vertical direction.

As shown in FIG. 1, the paper conveying mechanism 22 includes a conveying unit 28, a paper supplying unit 30, and a paper discharging unit 32. The conveying unit 28 conveys paper P in the horizontal direction. The paper supplying unit 30 is provided at an upstream side of the conveying unit 28 in the conveying direction and supplies the conveying unit 28 with paper P accommodated in the paper cassette 18. The paper discharging unit 32 is provided at a downstream side of the conveying unit 28 in the conveying direction and discharges paper P to the paper discharging section 12*a*. Here, the "sub-scanning direction" is a direction in which the conveying unit 28 conveys paper P, and the "main scanning direction" is a direction that is perpendicular to the conveying direction of paper P and that is a horizontal direction in FIG. 1 (that is, the direction perpendicular to the surface of the drawing sheet of FIG. 1). The plurality of head units 14*a*-14*d* is arranged in the sub-scanning direction above the conveying unit 28. Regions located below the head units 14*a*-14*d* are ejection regions Q1-Q4 in which ink is ejected, respectively.

Figure 2:
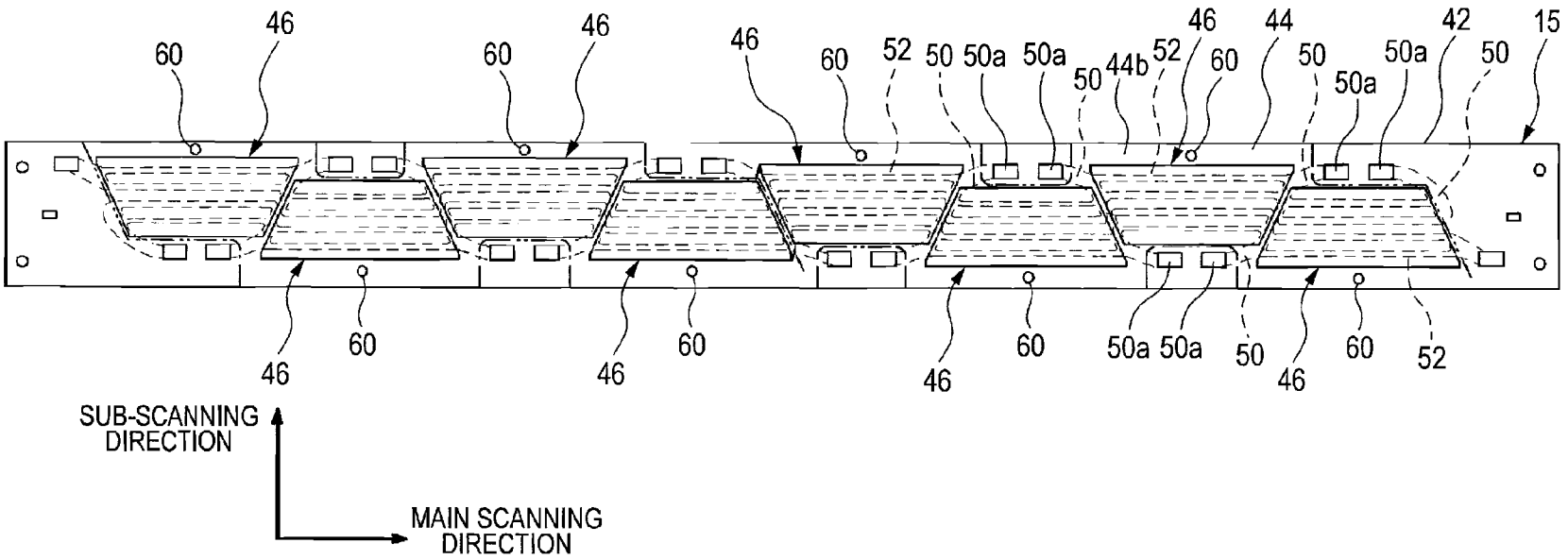
FIG. 2 is a plan view showing an ink ejecting head used in the inkjet printer.
Figure 3:
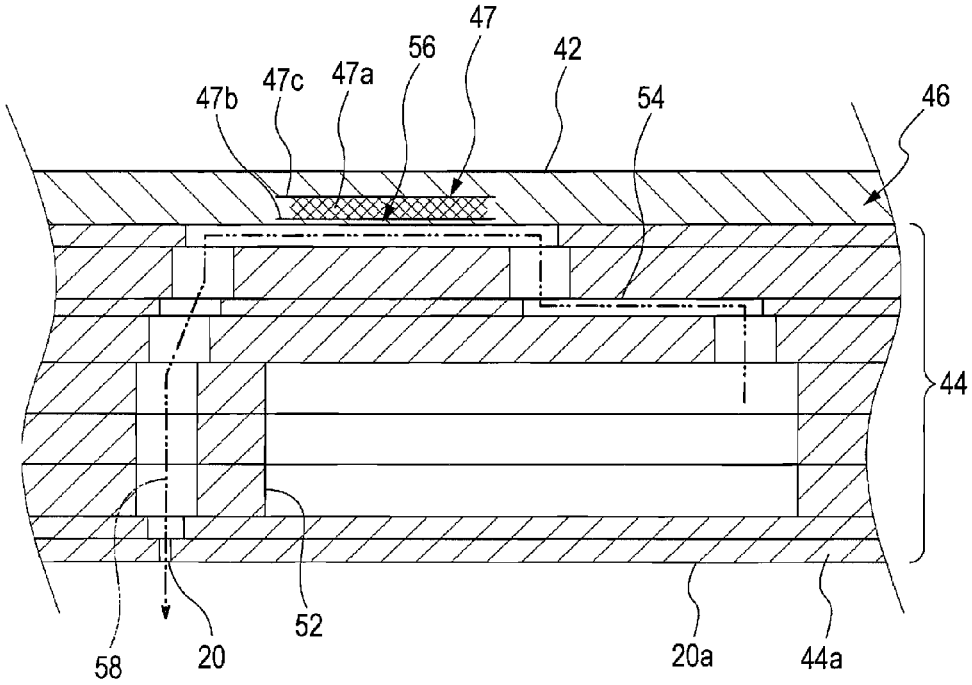
FIG. 3 is a partial enlarged cross-sectional view showing the ink ejecting head.

As shown in FIG. 1, each of the head units 14*a*-14*d* includes a head holder 40 and an ink ejecting head 15. The head holder 40 has substantially a rectangular parallelepiped shape extending in the main scanning direction. The ink ejecting head 15 is provided at the lower surface of the head holder 40 and extends in the main scanning direction. That is, the inkjet printer 10 is a line-type printer. As shown in FIGS. 2 and 3, the ink ejecting head 15 includes one channel unit 44 and a plurality (eight in the present embodiment) of driving sections 46 fixed on the upper surface of the channel unit 44.

As shown in FIG. 3, the channel unit 44 is a layered body made of a plurality of metal plates. A lower surface of a nozzle plate 44*a* constituting the lowermost layer serves as a nozzle surface 20*a* on which a plurality of nozzles 20 is formed. Within the channel unit 44, a manifold 50 (FIG. 2), a subsidiary manifold 52, and a plurality of individual ink channels 58 are formed. The subsidiary manifold 52 is in fluid communication with the manifold 50. The plurality of individual ink channels 58 is formed from the subsidiary manifold 52 to the nozzle 20 via an aperture 54 and a pressure chamber 56. As shown in FIG. 2, a plurality of ink supply ports 50*a* in fluid communication with respective ones of the manifold 50 is formed on an upper surface 44*b* of the channel unit 44. A reserve tank (not shown) in fluid communication with the ink supply ports 50*a* (FIG. 2) is provided above the ink ejecting head 15 within the head holder 40 (FIG. 1). The reserve tank is connected with a corresponding one of the ink tanks 16*a*-16*d* via a tube and a pump (not shown).

Figure 4:
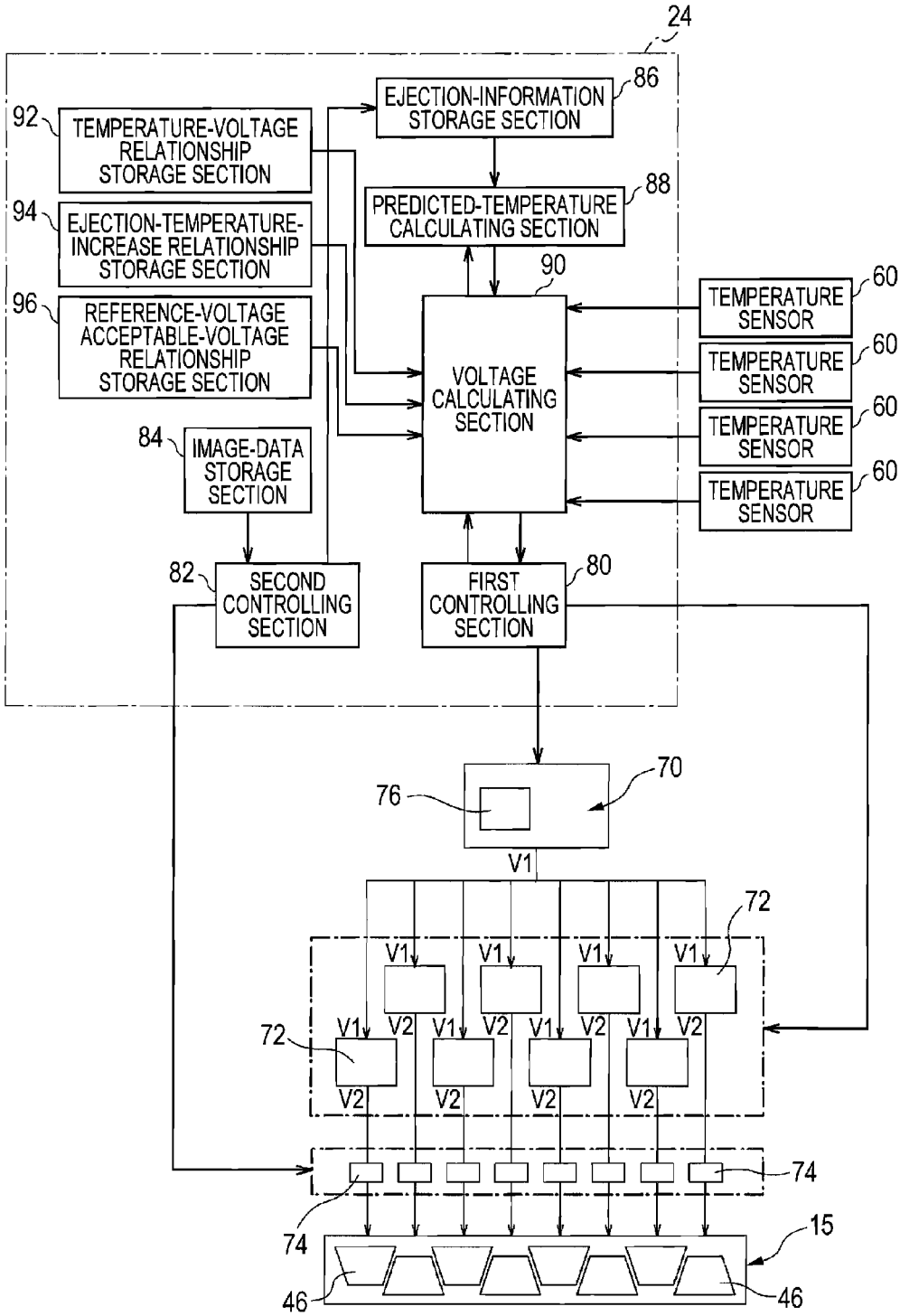
FIG. 4 is a block diagram showing the configuration of the inkjet printer.

As shown in FIG. 2, each of the plurality of driving sections 46 has substantially a trapezoidal shape in a plan view. The plurality of driving sections 46 are arranged in the main scanning direction such that upper and lower bases of adjacent driving sections 46 are located in opposite sides. As shown in FIG. 3, each of the plurality of driving sections 46 has a plurality of actuators 47 (indicated by the grid lines in FIG. 3) provided for respective ones of the pressure chambers 56. Each of the plurality of actuators 47 includes a piezoelectric layer 47*a* and a pair of electrodes 47*b* and 47*c* arranged to sandwich the piezoelectric layer 47*a*. A driving voltage V2 (for example, 28V) and a ground voltage (0V) are selectively supplied between the electrodes 47*b* and 47*c*, based on a pulse voltage outputted from a driver IC 74 (FIG. 4). When the driving voltage V2 is supplied between the electrodes 47*b* and 47*c*, the piezoelectric layer 47*a* contracts in a direction perpendicular to the thickness direction, and a part located below the piezoelectric layer 47*a* is deformed to be convex toward the inside of the pressure chamber 56. With this operation, the volume of the pressure chamber 56 decreases. This state is a basic state. When the ground voltage is supplied between the electrodes 47*b* and 47*c* in the basic state, a contracted state of the piezoelectric layer 47*a* is released and the volume of the pressure chamber 56 returns to the original size. That is, the volume of the pressure chamber 56 increases. Thus, if the ground voltage is supplied instantaneously between the electrodes 47*b* and 47*c* in the basic state, the volume of the pressure chamber 56 changes at a timing when the ground voltage is supplied, and ejection energy is applied to ink within the pressure chamber 56. This ejection energy causes ink to be ejected from the nozzle 20.

As shown in FIG. 2, temperature sensors 60 (an example of a head-temperature measuring section) for detecting temperature of the ink ejecting head 15 are provided at positions adjacent to respective ones of the plurality of driving sections 46 (the upper surface 44*b* of the channel unit 44 in the present embodiment) or at parts of the driving sections 46. As shown in FIG. 4, the temperature sensors 60 are electrically connected with the controller 24. Thus, the controller 24 can determine temperature of the ink ejecting head 15 for each driving section 46, based on outputs of the temperature sensors 60. Note that, in the present embodiment, the driving sections 46 and the temperature sensors 60 are provided basically in a one-to-one correspondence with each other. However, the driving sections 46 and the temperature sensors 60 need not be in a one-to-one correspondence with each other and, for example, one common temperature sensor 60 may be provided for a plurality of driving sections 46. In this modification, too, the controller 24 can determine temperature of each of the plurality of driving sections 46 based on distances from the common temperature sensor 60, for example.

As shown in FIG. 4, the inkjet printer 10 further includes a power supply section 70, a plurality of linear regulators 72 provided for respective ones of the plurality of driving sections 46, and a plurality of driver ICs 74 provided for the respective ones of the plurality of driving sections 46. A source voltage V1 outputted from the power supply section 70 is stepped down to the driving voltages V2 of the plurality of driving sections 46 by the respective linear regulators 72. The driving voltages V2 are supplied to the respective driving sections 46 through the driver ICs 74 as pulse voltages.

As shown in FIG. 4, the power supply section 70 includes a switching regulator 76 that outputs a source voltage V1. The switching regulator 76 switches a input voltage at a high speed to convert the input voltage into pulses, thereby obtaining a stable direct-current source voltage V1. In the present embodiment, a DC/DC convertor is used as the switching regulator 76. The type of the DC/DC convertor is not limited to a specific one, but may be any type of a step-down type, a step-up type, and a step-up/step-down type. Further, the kind of the switching regulator 76 is not limited to a DC/DC convertor, but may be a switched capacitor (step down), a charge pump (step up), or the like. As shown in FIG. 4, the power supply section 70 is connected with a first controlling section 80 of the controller 24. The first controlling section 80 controls the magnitude of the source voltage V1 and ON/OFF operations.

Figure 5:
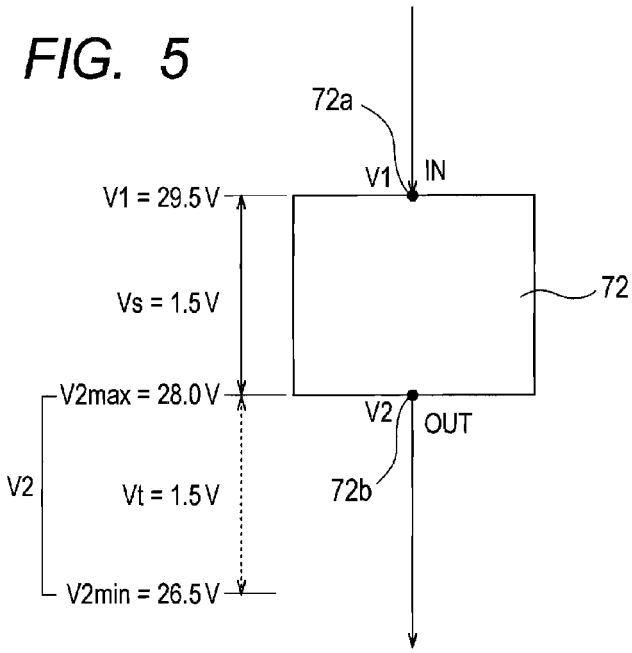
FIG. 5 is a block diagram showing the configuration of a linear regulator.

As shown in FIG. 4, the linear regulators 72 step down the source voltage V1 with resistances etc. to output stabilized driving voltages V2. In the present embodiment, three-terminal regulators are used as the linear regulators 72. The kind of the linear regulator 72 is not limited to three-terminal regulators, but shunt regulators or the like may be used. As shown in FIG. 5, when the source voltage V1 is supplied to an input terminal 72*a* of the linear regulator 72, the source voltage V1 is stepped down to the driving voltage V2 of a corresponding driving section 46 and is outputted from an output terminal 72*b*. As shown in FIG. 4, each of the plurality of linear regulators 72 is connected with the first controlling section 80 of the controller 24. The first controlling section 80 controls regulating amounts of the linear regulators 72 and ON/OFF operations. In the present embodiment, the source voltage V1 outputted from the power supply section 70 is directly supplied to the plurality of linear regulators 72 without being stepped down or stepped up. Further, the driving voltages V2 outputted from the plurality of linear regulators 72 are directly supplied to the plurality of driver ICs 74 without being stepped down or stepped up.

Figure 6:
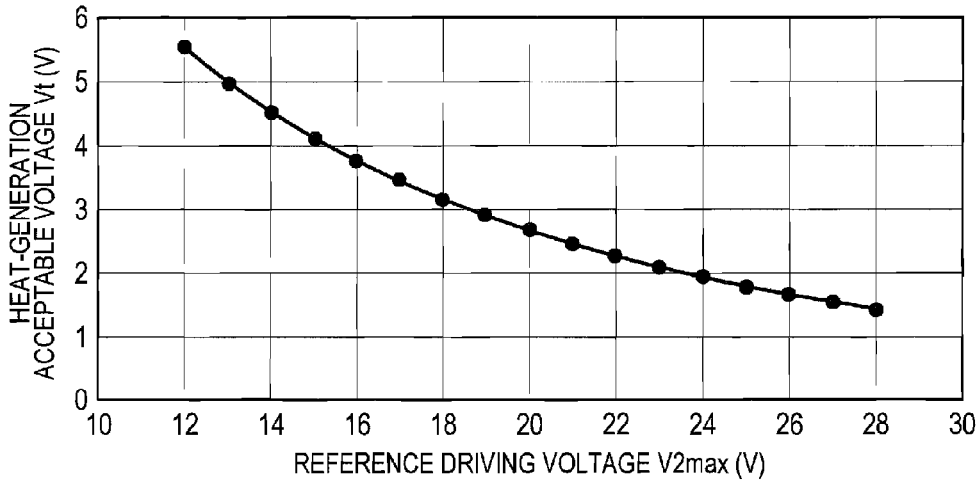
FIG. 6 is a graph showing the relationship between reference driving voltages and heat-generation acceptable voltages.

As shown in FIG. 5, in order to obtain stable driving voltages V2 in the linear regulators 72, a voltage difference (V1−V2) between the source voltage V1 and the driving voltage V2 need to be set to a value larger than or equal to a predetermined fixed voltage Vs (V1−V2≥Vs). In the present embodiment, the fixed voltage Vs is set to 1.5V, and the source voltage V1 is set to a voltage (for example, 29.5V) higher than a reference driving voltage V2max (for example, 28V) by the fixed voltage Vs (for example, 1.5V). The reference driving voltage V2max is a maximum voltage of the driving voltages V2 and is used as a reference value of the driving voltages V2. On the other hand, if the voltage difference (V1−V2) between the input terminal 72*a* and the output terminal 72*b* becomes too large, the amount of heat generation in the linear regulator 72 becomes too large, which causes a possibility that the circuit of the linear regulator 72 is deteriorated. Hence, as shown in FIG. 6, regarding the driving voltage V2 of the linear regulator 72, a heat-generation acceptable voltage Vt (for example, 1.5V) is set relative to the reference driving voltage V2max. A reference-voltage acceptable-voltage relationship storage section 96 (FIG. 4) stores relationship data (FIG. 6) between the reference driving voltage V2max and the heat-generation acceptable voltage Vt. An acceptable minimum voltage V2 min (26.5V) of the driving voltage is a value that is determined by subtracting the heat-generation acceptable voltage Vt (1.5V) from the reference driving voltage V2max (28V). That is, the driving voltage V2 need to be set to a value between the reference driving voltage V2max (28V) and the acceptable minimum voltage V2min (26.5V). The heat-generation acceptable voltage V t is set based on a fact that, if the reference driving voltage V2max increases as shown in FIG. 6, a current flowing through the linear regulator 72 increases and the amount of heat generation also increases.

As shown in FIG. 4, the driver ICs 74 are mounted on a flexible printed circuit board (not shown) connected with the driving sections 46. Each of the plurality of driver ICs 74 is connected with a second controlling section 82 of the controller 24. The driver IC 74 generates a pulse voltage based on the driving voltage V2 supplied from the linear regulator 72 and on print data supplied from the second controlling section 82, and supplies the pulse voltage to each of the plurality of actuators 47 (FIG. 3) of a corresponding driving section 46. The second controlling section 82 controls ON/OFF operations of the driver ICs 74.

As shown in FIG. 4, the controller 24 is a computer including a CPU (not shown), a non-volatile memory that stores programs executed by the CPU and various data in a rewritable manner, and a RAM that temporarily stores data during execution of the programs. The controller 24 operates in accordance with the programs, thereby realizing an image-data storage section 84, an ejection-information storage section 86, a predicted-temperature calculating section 88, a voltage calculating section 90, the first controlling section 80, and the second controlling section 82. That is, the controller 24 having the first controlling section 80, the second controlling section 82, and the like serves as a controller that performs various controls.

The controller 24 further includes a temperature-voltage relationship storage section 92, an ejection-temperature-increase relationship storage section 94, and the reference-voltage acceptable-voltage relationship storage section 96. The temperature-voltage relationship storage section 92 stores relationship between temperature and driving voltage of the driving section 46. The ejection-temperature-increase relationship storage section 94 stores relationship between the ejection amount of ink and temperature increase in the ink ejecting head 15. The reference-voltage acceptable-voltage relationship storage section 96 stores relationship data between the reference driving voltage V2max and the heat-generation acceptable voltage Vt, which is shown in the graph of FIG. 6.

As shown in FIG. 4, the image-data storage section 84 stores image data that are sent from a personal computer or the like (not shown). The image data include color density values for each pixel in a print region of paper P (FIG. 1). The second controlling section 82 generates print data based on image data stored in the image-data storage section 84 and, based on the print data, supplies voltage waveforms for driving the driver ICs 74. The print data include ejection amount data that are set in accordance with the color density values for each pixel. Ejection information including the ejection amount data is supplied from the second controlling section 82 to the ejection-information storage section 86. Further, the second controlling section 82 has a function of controlling ON/OFF operations of the driver ICs 74.

As shown in FIG. 4, the ejection-information storage section 86 stores ink ejection information supplied from the second controlling section 82. The predicted-temperature calculating section 88 calculates predicted future temperature of the ink ejecting head 15. That is, the predicted-temperature calculating section 88 calculates future temperature of the ink ejecting head 15 based on temperature measured by the temperature sensor 60 and on an extent of temperature increase determined from the ink ejection information. Here, the ejection-temperature-increase relationship storage section 94 preliminarily stores the relationship between the amount of ink ejection and temperature increase in a format of a table, an equation, or the like, so that the temperature increase can be determined from the amount of ink ejection (which is calculated from dot sizes and the number of dots). For example, if it is predicted that the amount of ink ejection increases based on the ejection amount data included in the ejection information, the predicted-temperature calculating section 88 determines that temperature of the ink ejecting head 15 becomes higher in accordance with the amount of ink ejection, and obtains a high calculated value of the future temperature of the ink ejecting head 15.

As shown in FIG. 4, the voltage calculating section 90 calculates the source voltage V1 and the driving voltages V2 to be supplied to respective ones of the plurality of driving sections 46, based on predicted temperatures calculated by the predicted-temperature calculating section 88 (or, based on current temperatures measured by the temperature sensors 60 in a modification described later). As shown in FIG. 5, it is assumed that the reference driving voltage V2max (a maximum voltage of the driving voltages V2) is 28V in this example. The fixed voltage Vs is set to 1.5V. Thus, the voltage calculating section 90 calculates the source voltage V1 and obtains 29.5V in accordance with an equation "source voltage V1=reference driving voltage V2max+fixed voltage Vs". As shown in FIG. 3, the actuators 47 of the present embodiment are piezoelectric actuators and, as temperature of the piezoelectric layer 47*a* is lower, a higher driving voltage V2 need to be supplied to cause the same amount of deformation. If the outside air temperature around the ink ejecting head 15 is low, the driving voltages V2 in all the linear regulators 72 need to be high. Thus, the source voltage V1 need to be high in order to set all the driving voltages V2 to values between the reference driving voltage V2max and the acceptable minimum voltage V2 min, as described earlier. The temperature-voltage relationship storage section 92 in the controller 24 preliminarily stores the relationship between the driving voltage V2 and the temperature calculated by the predicted-temperature calculating section 88 (or, the temperature measured by the temperature sensors 60 in the modification described later) in a format of a table, an equation, or the like. The voltage calculating section 90 calculates the source voltage V1 based on a maximum voltage of the driving voltages V2 (the reference driving voltage V2max) in the respective linear regulators 72 (in S5 and S17 in FIG. 7). Specifically, the source voltage V1 is calculated by adding the fixed voltage Vs (1.5V) to the maximum voltage of the driving voltages V2 in the linear regulators 72. Note that, considering variability in characteristics of the linear regulators 72 etc., the controller may store relationship between temperatures and driving voltages V2 for each linear regulator 72, and may calculate the driving voltage V2 and the source voltage V1 for each linear regulator 72.

The driving voltage V2 in each linear regulator 72 is calculated as a value adjusted from the reference driving voltage V2max based on the temperature of the ink ejecting head 15. In other words, if the temperature of the ink ejecting head 15 increases, the amount of ink ejected from the nozzle 20 increases even if the same driving voltage V2 is supplied. Thus, in order to optimize the amount of ink ejection, the driving voltage V2 is calculated (adjusted) to be lower than the reference driving voltage V2max (28V), based on the temperature of the ink ejecting head 15. The temperature of the ink ejecting head 15 increases as the ink ejecting head 15 ejects ink if influences due to changes in the outside temperature are ignored.

As shown in FIG. 4, the first controlling section 80 controls the magnitude of the source voltage V1 outputted from the power supply section 70 and ON/OFF operations of the power supply section 70, as well as the regulating amounts of the linear regulators 72 and ON/OFF operations of the linear regulators 72. If the voltage difference (V1−V2) between the source voltage V1 calculated by the voltage calculating section 90 and the minimum voltage among the driving voltages V2 calculated by the voltage calculating section 90 is larger than or equal to an acceptable value, the first controlling section 80 and the second controlling section 82 of the controller 24 controls the power supply section 70, the plurality of linear regulators 72, and the plurality of driving sections 46 to stop at least one of outputting of the source voltage V1 by the power supply section 70, supplying of the driving voltages V2 by the plurality of linear regulators 72, and driving of the plurality of driving sections 46. In the example shown in FIG. 5, the reference driving voltage V2max is 28V, the fixed voltage Vs is 1.5V, and the source voltage V1 is 29.5V which is higher than the reference driving voltage V2max (28V) by the fixed voltage Vs (1.5V). From the graph in FIG. 6, if the reference driving voltage V2max is 28V, the heat-generation acceptable voltage Vt is 1.5V. Accordingly, the acceptable minimum voltage V2min of the driving voltage is calculated as V2 min=V2max−Vt=28−1.5=26.5V. Hence, the acceptable value (V1−V2 min) is calculated as V1−V2 min=29.5−26.5=3V.

Figure 8:
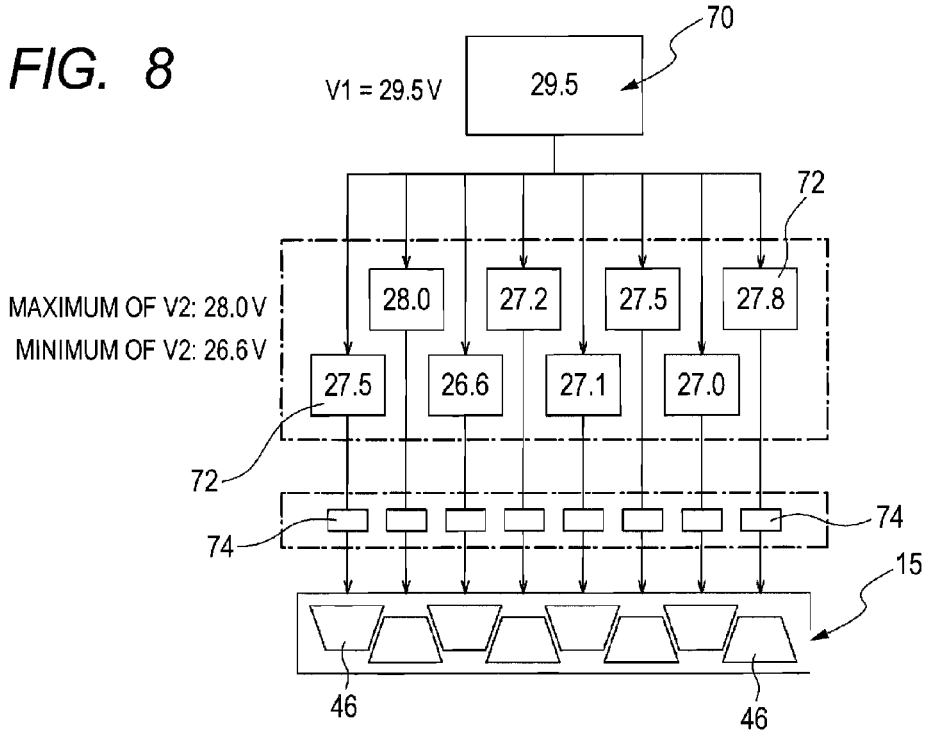
FIG. 8 is a block diagram showing a state in which a voltage difference between a source voltage and a minimum voltage of driving voltages is smaller than an acceptable value.
Figure 9:
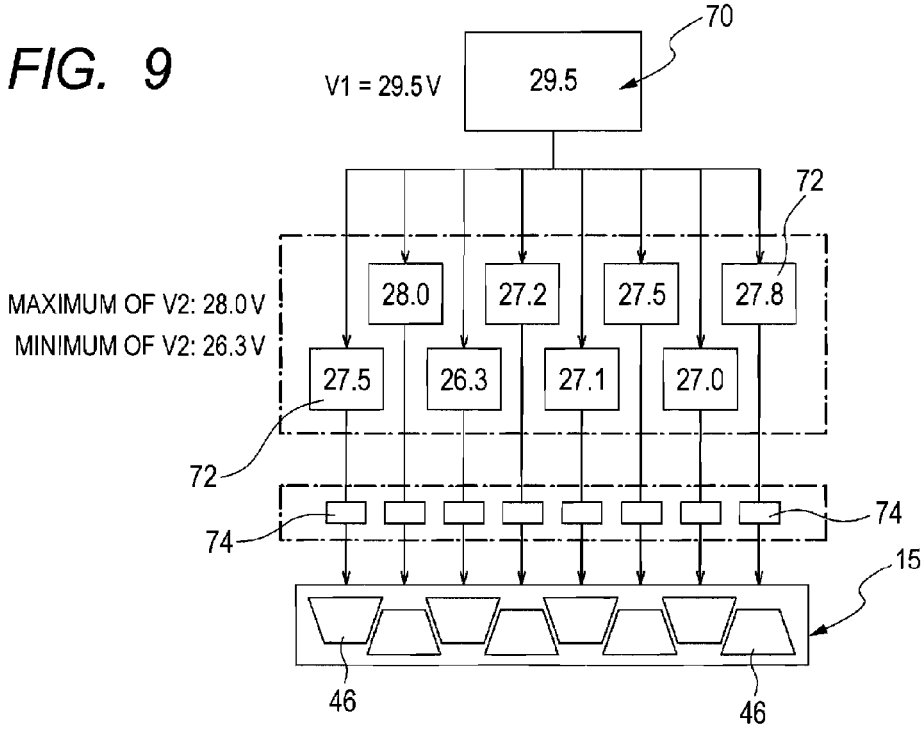
FIG. 9 is a block diagram showing a state in which the voltage difference between the source voltage and the minimum voltage of driving voltages is larger than or equal to the acceptable value.

A control operation performed by the controller 24 is described with reference to FIGS. 7 through 9. Here, numbers shown in the power supply section 70 in FIGS. 8 and 9 are values of the source voltage V1, and numbers shown in the linear regulators 72 are values of the driving voltages V2.

Figure 7:
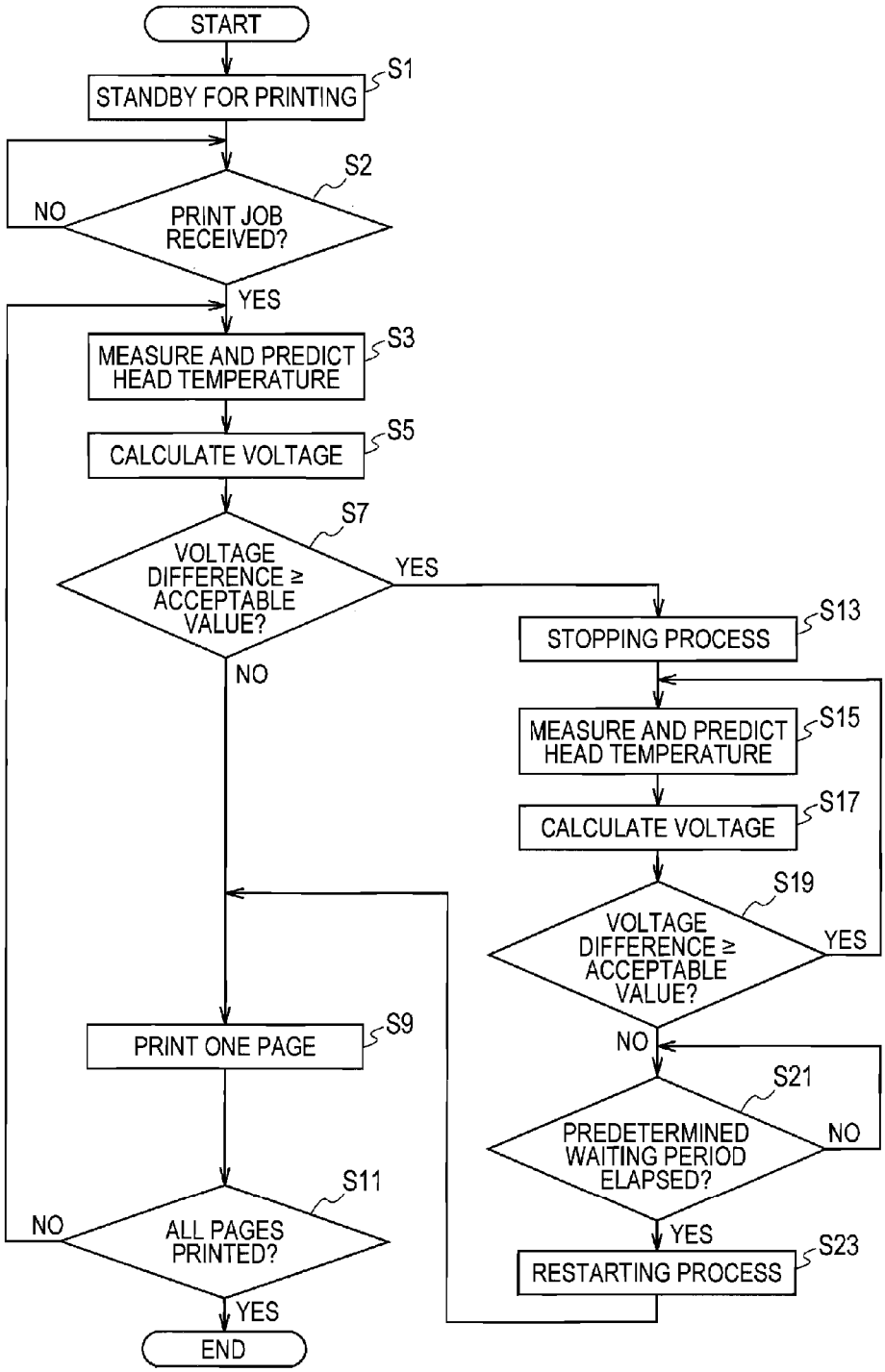
FIG. 7 is a flowchart showing a control operation of a computer (controller)

The controller 24 performs a control operation as shown in FIG. 7. First, in S1, the inkjet printer 10 is set to a print standby state. The print standby state is a state in which a print operation can be performed based on print data that are supplied from the second controlling section 82 (FIG. 4) to the driver ICs 74 (FIG. 4). In S2, the controller 24 determines whether a print job is received from a personal computer or the like. If the print job is received (S2: Yes), in S3, the controller 24 acquires current temperatures of the ink ejecting head 15 from the temperature sensors 60. Further, the predicted-temperature calculating section 88 calculates predicted temperatures of the ink ejecting head 15 after printing of a first page of the print job. Specifically, the predicted-temperature calculating section 88 calculates the amount of ink ejection based on the dot sizes and the number of dots corresponding to print data for the first page. As described above, the relationship between the amount of ink ejection and the temperature increase is preliminarily stored in a table, an equation, etc. in the ejection-temperature-increase relationship storage section 94. Thus, the predicted-temperature calculating section 88 determines the temperature increase from the amount of ink ejection. The predicted-temperature calculating section 88 then calculates predicted temperature of the ink ejecting head 15 after printing of the first page, by adding the temperature increase to the current temperature acquired from the temperature sensor 60.

In S5, the voltage calculating section 90 calculates the source voltage V1 and the driving voltages V2. As described above, the relationship between temperature and the driving voltage V2 is preliminarily stored in the controller 24. Thus, the voltage calculating section 90 determines the driving voltage V2 from the predicted temperature subsequent to printing of the first page, which is calculated in S3. Further, the voltage calculating section 90 calculates the source voltage V1 by adding the fixed voltage Vs to the reference driving voltage V2max. Further, the voltage calculating section 90 determines the heat-generation acceptable voltage Vt based on the reference driving voltage V2max and on the relationship data stored in the reference-voltage acceptable-voltage relationship storage section 96, determines the acceptable minimum voltage V2min by subtracting the heat-generation acceptable voltage Vt from the reference driving voltage V2max, and determines the acceptable value (V1−V2 min) by subtracting the acceptable minimum voltage V2min from the source voltage V1.

In S7, the controller 24 determines whether the voltage difference (V1−V2) between the source voltage V1 and the minimum voltage of the driving voltages V2 is larger than or equal to an acceptable value. If it is determined that the voltage difference (V1−V2) is smaller than the acceptable value (S7: No), in S9, printing is performed for one page of the print job based on print data. In the example of FIG. 8, the voltage difference (V1−V2) between the source voltage V1 (29.5V) and the minimum voltage of the driving voltages V2 (26.6V) is 2.9V, and hence a "No" determination is made in S7. As shown in FIG. 8, in a printing operation in S9, the power supply section 70 operates to output the source voltage V1 (29.5V) calculated in S5, and each of the plurality of linear regulators 72 operates to output the driving voltage V2 calculated in S5. After printing for one page is finished in S9, in S11, the controller 24 determines whether printing for all the pages of the print job is finished. If printing for all the pages of the print job is finished (S11: Yes), the process ends. If there is a page for which printing is not finished (S11: No), the process returns to S3.

If it is determined that the voltage difference (V1−V2) is larger than or equal to the acceptable value (3V) (S7: Yes), in S13 the controller 24 performs a stopping process of the printing operation. That is, as shown in FIG. 4, the first controlling section 80 and the second controlling section 82 of the controller 24 controls the power supply section 70, the plurality of linear regulators 72, and the plurality of driving sections 46 to stop at least one of outputting of the source voltage V1 by the power supply section 70, supplying of the driving voltages V2 by the plurality of linear regulators 72, and driving of the plurality of driving sections 46. In the example of FIG. 9, the voltage difference (V1−V2) between the source voltage V1 (29.5V) and the minimum voltage of the driving voltages V2 (26.3V) is 3.2V, and hence a "Yes" determination is made in S7.

If there is a page that is not printed yet in S11 (S11: No) after printing the first page in the print job, the processes in S3 and thereafter are repeated for the subsequent page (the second page) of the print job. More specifically, in S3, the controller 24 acquires the current head temperatures and calculates predicted temperatures after printing the second page. In S5, the voltage calculating section 90 calculates the driving voltages V2 based on the predicted temperatures after printing the second page. In S7, the controller 24 determines whether the voltage difference (V1−V2) is larger than or equal to the acceptable value. Printing is performed for the second page (S9) if the voltage difference (V1−V2) is smaller than the acceptable value (S7: No), and printing is stopped (S13) if the voltage difference (V1−V2) is larger than or equal to the acceptable value (S7: Yes). The same processes are repeated for the third page and thereafter.

As described above, in the present embodiment, the predicted-temperature calculating section 88 calculates predicted temperatures of the ink ejecting head 15 in S3. If it is determined that the voltage difference (V1−V2) is larger than or equal to the acceptable value (3V) (S7: Yes), in S13 the first controlling section 80 and the second controlling section 82 of the controller 24 controls the power supply section 70, the plurality of linear regulators 72, and the plurality of driving sections 46 to stop at least one of outputting of the source voltage V1 by the power supply section 70, supplying of the driving voltages V2 by the plurality of linear regulators 72, and driving of the plurality of driving sections 46, prior to starting ejection of ink onto paper P (FIG. 1) that is the subject of prediction. That is, the driving voltages V2 are monitored for each paper P and, if the voltage difference (V1–V2) is larger than or equal to the acceptable value (3V), a print operation is stopped prior to starting printing onto the paper P.

After the print operation is stopped, the controller 24 executes processes in S15, S17, and S19. The processes in S15 and S17 are basically the same as the processes in S3 and S5. If it is determined in S19 that the voltage difference (V1–V2) is larger than or equal to the acceptable value (3V) (S19: Yes), the controller 24 returns to S15 to continue the stopped state. If it is determined that the voltage difference (V1–V2) is smaller than the acceptable value (3V) (S19: No), the controller 24 proceeds to S21.

In S21, the controller 24 determines whether a predetermined waiting period has elapsed and, if not (S21: No), waits until the predetermined waiting period elapses. If it is determined that the predetermined waiting period has elapsed (S21: Yes), the controller 24 executes a restarting process of the print operation in S23 and in S9 performs printing for the page for which printing is stopped. In the restarting process of S23, the first controlling section 80 and the second controlling section 82 of the controller 24 control the power supply section 70, the plurality of linear regulators 72, and the plurality of driving sections 46 to restart the stopped operation of outputting of the source voltage V1 by the power supply section 70, supplying of the driving voltages V2 by the plurality of linear regulators 72, and driving of the plurality of driving sections 46.

As shown in FIG. 4, in the present embodiment, if the voltage difference (V1–V2) between the source voltage V1 and the minimum voltage among the driving voltages V2 is larger than or equal to the acceptable value, at least one operation of outputting of the source voltage V1 by the power supply section 70, supplying of the driving voltages V2 by the plurality of linear regulators 72, and driving of the plurality of driving sections 46 is stopped. This suppresses heat generation in each of the plurality of linear regulators 72, thereby suppressing deterioration of the linear regulators 72.

As shown in FIG. 7, in the present embodiment, the controller 24 (FIG. 4) serves as a detecting section that detects that the voltage difference (V1–V2) becomes smaller than the acceptable value (3V) after a state where the voltage difference (V1–V2) is larger than or equal to the acceptable value (3V) (S15 through S19). Thus, the restarting process of the print operation in S21 and S23 can be performed automatically.

As shown in FIG. 7, in the present embodiment, if in S19 the controller 24 (FIG. 4) detects that the voltage difference (V1–V2) becomes less than the acceptable value (3V) after a state where the voltage difference (V1–V2) is larger than or equal to the acceptable value (3V), the controller 24 restarts the stopped operation of outputting of the source voltage V1 by the power supply section 70, supplying of the driving voltages V2 by the plurality of linear regulators 72, and driving of the plurality of driving sections 46 after the predetermined waiting period elapses from a time point of the detection. This prevents a situation in which stoppage and restart of supplying of the driving voltages V2 are repeated in a short period, thereby securing stability of the operations.

As shown in FIG. 7, in the present embodiment, if it is determined in S7 that the voltage difference (V1–V2) is larger than or equal to the acceptable value (3V) (S7: Yes), outputting of the source voltage V1 by the power supply section 70 or the like is stopped prior to starting ejection of ink onto paper P (FIG. 1) that is the subject of prediction. This prevents a situation in which ejection of ink is stopped in the middle of printing of paper P, thereby preventing wasteful consumption of paper P and ink. Further, the above-mentioned feature can save labor of removing paper P that is printed up to the middle of the sheet in order to restart the print operation, thereby enabling a quick restarting process.

As shown in FIG. 4, the controller 24 includes: the first controlling section 80 that controls the power supply section 70 and the plurality of linear regulators 72; and the second controlling section 82 that controls driving of the plurality of driving sections 46. This enables the first controlling section 80 and the second controlling section 82 to be arranged separately, thereby improving the degree of freedom of arrangement of these controlling sections.

While the invention has been described in detail with reference to the above aspects thereof, it would be apparent to those skilled in the art that various changes and modifications may be made therein without departing from the scope of the claims. In the following descriptions, like parts and components are designated by the same reference numerals to avoid duplicating description.

Figure 10A:
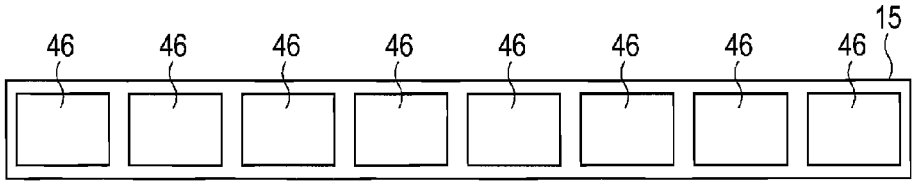
FIG. 10A is a schematic view showing an arrangement of driving sections on the ink ejecting head according to the embodiment.
Figure 10B:
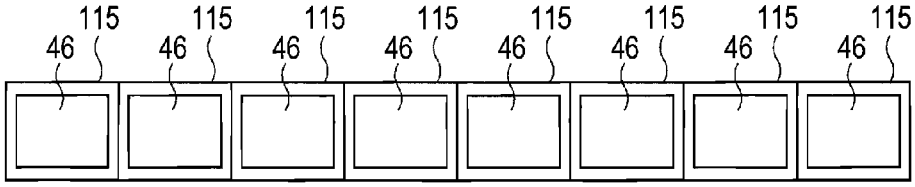
FIGS. 10B through 10D are schematic views showing arrangements of driving sections on ink ejecting heads according to modifications.
Figure 10C:
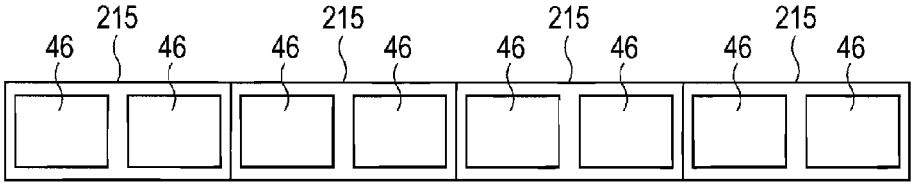
Figure 10D:
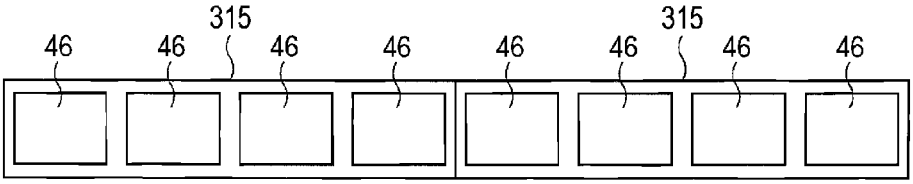

For example, as shown in FIG. 2, in the above-described embodiment, each of the head units 14*a*-14*d* includes one ink ejecting head 15 having the plurality (eight in the embodiment) of driving sections 46. This configuration is schematically shown in FIG. 10A. In another embodiment, however, each of the head units 14*a*-14*d* may include a plurality of ink ejecting heads each having at least one driving section. For example, as shown in FIG. 10B, each of the head units 14*a*-14*d* may include eight ink ejecting heads 115 each having one driving section 46. Or, as shown in FIG. 10C, each of the head units 14*a*-14*d* may include four ink ejecting heads 215 each having two driving sections 46. Or, as shown in FIG. 10D, each of the head units 14*a*-14*d* may include two ink ejecting heads 315 each having four driving sections 46.

As shown in FIG. 7, in the above-described embodiment, in S3 the predicted-temperature calculating section 88 calculates predicted temperatures of the ink ejecting head 15 subsequent to printing of a page in a print job. In S5, the voltage calculating section 90 determines the source voltage V1 and the driving voltages V2 from the predicted temperatures. Then, in S7, the controller 24 determines whether the voltage difference (V1–V2) is larger than or equal to the acceptable value. That is, the determination is based on the predicted temperatures calculated in S3. The same goes for the processes in S15, S17, and S19. In another embodiment, however, determinations in S7 and S19 may be based on the current temperatures of the ink ejecting head 15. In this case, in S3 and S15, the controller 24 acquires current temperatures of the ink ejecting head 15 from the temperature sensors 60, but need not calculate predicted temperatures. The predicted-temperature calculating section 88 (FIG. 4) may be omitted. With this modification, the amount of calculation can be reduced.

As shown in FIG. 4, in the above-described embodiment, the controller 24 has the first controlling section 80 and the second controlling section 82. In another embodiment, however, the first controlling section 80 and the second controlling section 82 may be integrated in a single unit.

As shown in FIG. 7, in the above-described embodiment, determination of whether to perform printing is performed in S7 after a print job is received. Further, determination of whether to perform printing (S7) and the stopping process (S13) through the restarting process (S23) are performed during a print operation. In another embodiment, however, determination of whether to perform printing may be performed at a print standby state.

As shown in FIG. 1, in the above-described embodiment, the invention is applied to an inkjet printer that ejects ink. In another embodiment, however, the invention may be applied to a liquid ejecting device that ejects another kind of liquid. Further, in the above-described embodiment, the piezoelectric actuator type is used as a type of ejecting liquid. However, other types of ejection may be employed, such as a type of ejecting liquid by utilizing pressure generated when the volume of liquid is expanded by a heater element.

In the above-described embodiment, a single CPU may perform all of the processes. Nevertheless, the disclosure may not be limited to the specific embodiment thereof, and a plurality of CPUs, a special application specific integrated circuit ("ASIC"), or a combination of a CPU and an ASIC may be used to perform the processes.

What is claimed is:

1. A liquid ejecting device comprising:

a liquid ejecting head having a plurality of driving sections for ejecting liquid;

a power supply section including a switching regulator configured to output a source voltage;

a plurality of linear regulators provided for respective ones of the plurality of driving sections, the plurality of linear regulators being configured to step down the source voltage to respective driving voltages of the plurality of driving sections and to supply the respective ones of the plurality of driving sections with the driving voltages;

a head-temperature sensor configured to measure temperature of the liquid ejecting head; and a controller configured to:

determine the source voltage and the driving voltages based on the temperature measured by the head-temperature sensor; and control the power supply section, the plurality of linear regulators, and the plurality of driving sections to perform a stopping process of a liquid ejecting operation by stopping at least one of outputting of the source voltage by the power supply section, supplying of the driving voltages by the plurality of linear regulators, and driving of the plurality of driving sections, when a voltage difference is larger than or equal to a calculation value calculated based on the temperature, the voltage difference being a difference between the source voltage and a minimum voltage of the driving voltages.

2. The liquid ejecting device according to claim 1, wherein the controller is further configured to restart a stopped operation among outputting of the source voltage by the power supply section, supplying of the driving voltages by the plurality of linear regulators, and driving of the plurality of driving sections, when the voltage difference becomes less than the calculation value after a state where the voltage difference is larger than or equal to the calculation value.

3. The liquid ejecting device according to claim 2, wherein, when the voltage difference becomes less than the calculation value after the state where the voltage difference is larger than or equal to the calculation value, the controller is configured to restart the stopped operation among outputting of the source voltage by the power supply section, supplying of the driving voltages by the plurality of linear regulators, and driving of the plurality of driving sections after a predetermined waiting period elapses after the voltage difference becomes less than the calculation value.

4. The liquid ejecting device according to claim 1, wherein the controller is further configured to determine a predicted temperature of the liquid ejecting head based on ejection information of liquid ejected onto a recording medium, wherein, when the voltage difference is larger than or equal to the calculation value based on the predicted temperature, the controller is configured to control the power supply section, the plurality of linear regulators, and the plurality of driving sections to stop at least one of outputting of the source voltage by the power supply section, supplying of the driving voltages by the plurality of linear regulators, and driving of the plurality of driving sections, before the liquid ejecting head starts ejection of liquid onto the recording medium.

5. The liquid ejecting device according to claim 4, further comprising a ejection-temperature-increase relationship storage section configured to store relationship data between the ejection information and temperature increases, wherein the controller is configured to determine a temperature increase based on the ejection information and on the relationship data stored in the ejection-temperature-increase relationship storage section, and to add the temperature increase to the temperature measured by the head-temperature sensor, thereby determining the predicted temperature.

6. The liquid ejecting device according to claim 4, further comprising a temperature-voltage relationship storage section configured to store relationship data between driving voltages and temperatures, wherein the controller is configured to determine the driving voltages for the respective ones of the plurality of driving sections based on the predicted temperature and on the relationship data stored in the temperature-voltage relationship storage section, to determine a maximum voltage of the driving voltages serving as a reference driving voltage, and to add a fixed voltage to the reference driving voltage, thereby determining the source voltage.

7. The liquid ejecting device according to claim 6, further comprising a reference-voltage correspondence-voltage relationship storage section configured to store relationship data between the reference driving voltage and a heat-generation correspondence voltage, wherein the controller is configured to determine the heat-generation correspondence voltage based on the reference driving voltage and on the relationship data stored in the reference-voltage correspondence-voltage relationship storage section, to determine a calculation minimum voltage by subtracting the heat-generation correspondence voltage from the reference driving voltage, and to determine the calculation value by subtracting the calculation minimum voltage from the source voltage.

8. The liquid ejecting device according to claim 1, wherein, when the voltage difference is larger than or equal to the calculation value based on a current temperature measured by the head-temperature sensor, the controller is configured to control the power supply section, the plurality of linear regulators, and the plurality of driving sections to stop at least one of outputting of the source voltage by the power supply section, supplying of the driving voltages by the plurality of linear regulators, and driving of the plurality of driving sections, before the liquid ejecting head starts ejection of liquid onto the recording medium.

9. The liquid ejecting device according to claim 1, wherein the controller comprises:

a first controlling section configured to control the power supply section and the plurality of linear regulators; and a second controlling section configured to control driving of the plurality of driving sections.

10. The liquid ejecting device according to claim 1, wherein the head-temperature sensor comprises a plurality of temperature sensors provided in a one-to-one correspondence with the plurality of driving sections.

11. A storage medium storing a set of program instructions executable on a liquid ejecting device including: a liquid ejecting head having a plurality of driving sections for ejecting liquid; a power supply section including a switching regulator configured to output a source voltage; a plurality of linear regulators provided for respective ones of the plurality of driving sections, the plurality of linear regulators being configured to step down the source voltage to respective driving voltages of the plurality of driving sections and to supply the respective ones of the plurality of driving sections with the driving voltages; and a head-temperature sensor configured to measure temperature of the liquid ejecting head, the set of program instructions comprising:

measuring temperature of the liquid ejecting head with the head-temperature sensor;

determining the source voltage and the driving voltages based on the temperature measured by the head-temperature sensor; and controlling the power supply section, the plurality of linear regulators, and the plurality of driving sections to perform a stopping process of a liquid ejecting operation by stopping at least one of outputting of the source voltage by the power supply section, supplying of the driving voltages by the plurality of linear regulators, and driving of the plurality of driving sections, when a voltage difference is larger than or equal to a calculation value calculated based on the temperature, the voltage difference being a difference between the source voltage and a minimum voltage of the driving voltages.

12. The storage medium according to claim 11, wherein the set of program instructions further comprises restarting a stopped operation among outputting of the source voltage by the power supply section, supplying of the driving voltages by the plurality of linear regulators, and driving of the plurality of driving sections, when the voltage difference becomes less than the calculation value after a state where the voltage difference is larger than or equal to the calculation value.

13. The storage medium according to claim 12, wherein the instructions for restarting a stopped operation comprise restarting, when the voltage difference becomes less than the calculation value after the state where the voltage difference is larger than or equal to the calculation value, the stopped operation among outputting of the source voltage by the power supply section, supplying of the driving voltages by the plurality of linear regulators, and driving of the plurality of driving sections after a predetermined waiting period elapses after the voltage difference becomes less than the calculation value.

14. The storage medium according to claim 11, wherein the instructions for determining the source voltage and the driving voltages comprise determining a predicted temperature of the liquid ejecting head based on ejection information of liquid ejected onto a recording medium; and wherein the instructions for controlling the power supply section, the plurality of linear regulators, and the plurality of driving sections comprise controlling, when the voltage difference is larger than or equal to the calculation value based on the predicted temperature, the power supply section, the plurality of linear regulators, and the plurality of driving sections to stop at least one of outputting of the source voltage by the power supply section, supplying of the driving voltages by the plurality of linear regulators, and driving of the plurality of driving sections, before the liquid ejecting head starts ejection of liquid onto the recording medium.

15. The storage medium according to claim 14, further comprising a ejection-temperature-increase relationship storage section configured to store relationship data between the ejection information and temperature increases, wherein the instructions for determining a predicted temperature comprise determining a temperature increase based on the ejection information and on the relationship data stored in the ejection-temperature-increase relationship storage section, and to add the temperature increase to the temperature measured by the head-temperature sensor, thereby determining the predicted temperature.

16. The storage medium according to claim 14, further comprising a temperature-voltage relationship storage section configured to store relationship data between driving voltages and temperatures, wherein the instructions for determining the source voltage and the driving voltages further comprise determining the driving voltages for the respective ones of the plurality of driving sections based on the predicted temperature and on the relationship data stored in the temperature-voltage relationship storage section, determining a maximum voltage of the driving voltages, and adding a fixed voltage to the maximum voltage of the driving voltages, thereby determining the source voltage.

17. The storage medium according to claim 16, further comprising a reference-voltage correspondence-voltage relationship storage section configured to store relationship data between the reference driving voltage and a heat-generation correspondence voltage, wherein the set of program instructions further comprises determining the heat-generation correspondence voltage based on the reference driving voltage and on the relationship data stored in the reference-voltage correspondence-voltage relationship storage section, determining a calculation minimum voltage by subtracting the heat-generation correspondence voltage from the reference driving voltage, and determining the calculation value by subtracting the calculation minimum voltage from the source voltage.

18. The storage medium according to claim 11, wherein the instructions for controlling the power supply section, the plurality of linear regulators, and the plurality of driving sections comprise controlling, when the voltage difference is larger than or equal to the calculation value based on a current temperature measured by the head-temperature sensor, the power supply section, the plurality of linear regulators, and the plurality of driving sections to stop at least one of outputting of the source voltage by the power supply section, supplying of the driving voltages by the plurality of linear regulators, and driving of the plurality of driving sections, before the liquid ejecting head starts ejection of liquid onto the recording medium.

19. A method of controlling a liquid ejecting device including: a liquid ejecting head having a plurality of driving sections for ejecting liquid; a power supply section including a switching regulator configured to output a source voltage; a plurality of linear regulators provided for respective ones of the plurality of driving sections, the plurality of linear regulators being configured to step down the source voltage to respective driving voltages of the plurality of driving sections and to supply the respective ones of the plurality of driving sections with the driving voltages; and a head-temperature sensor configured to measure temperature of the liquid ejecting head, the method comprising:

measuring temperature of the liquid ejecting head with the head-temperature sensor;

determining the source voltage and the driving voltages based on the temperature measured by the head-temperature sensor; and controlling the power supply section, the plurality of linear regulators, and the plurality of driving sections to perform a stopping process of a liquid ejecting operation by stopping at least one of outputting of the source voltage by the power supply section, supplying of the driving voltages by the plurality of linear regulators, and driving of the plurality of driving sections, when a voltage difference is larger than or equal to a calculation value calculated based on the temperature, the voltage difference being a difference between the source voltage and a minimum voltage of the driving voltages.

20. A liquid ejecting device comprising:

a plurality of liquid ejecting heads each having at least one driving section for ejecting liquid, thereby having a plurality of driving sections in total;

a power supply section including a switching regulator configured to output a source voltage;

a plurality of linear regulators provided for respective ones of the plurality of driving sections, the plurality of linear regulators being configured to step down the source voltage to respective driving voltages of the plurality of driving sections and to supply the respective ones of the plurality of driving sections with the driving voltages;

a plurality of head-temperature sensors configured to measure temperatures of the plurality of liquid ejecting heads; and a controller configured to:

determine the source voltage and the driving voltages based on the temperatures measured by the plurality of head-temperature sensors; and control the power supply section, the plurality of linear regulators, and the plurality of driving sections to perform a stopping process of a liquid ejecting operation by stopping at least one of outputting of the source voltage by the power supply section, supplying of the driving voltages by the plurality of linear regulators, and driving of the plurality of driving sections, when a voltage difference is larger than or equal to a calculation value calculated based on the temperature, the voltage difference being a difference between the source voltage and a minimum voltage of the driving voltages.

21. The liquid ejecting device according to claim 1, wherein the calculation value is determined by subtracting a voltage V2min from the source voltage, the source voltage being calculated based on the temperature, the voltage V2min being determined by subtracting a heat-generation correspondence voltage Vt from a voltage V2max, the voltage V2max being a maximum voltage of the driving voltages serving as a reference driving voltage.

* * * * *